US005682501A

United States Patent [19]

Sharman

[11] Patent Number: 5,682,501

[45] Date of Patent: Oct. 28, 1997

[54] SPEECH SYNTHESIS SYSTEM

[75] Inventor: Richard Anthony Sharman, Southampton, United Kingdom

[73] Assignee: International Business Machines Corporation, Armonk, N.Y.

[21] Appl. No.: 391,731

[22] Filed: Feb. 21, 1995

[30] Foreign Application Priority Data

Jun. 22, 1994 [GB] United Kingdom ..... 9412555

[51] Int. Cl.[6] ..... G10L 00/00

[52] U.S. Cl. ..... 395/2.69; 395/2.75; 395/2.78; 395/2.67

[58] Field of Search ..... 381/41, 43; 395/2.65, 395/2.66, 2.75, 2.67, 2.7

[56] References Cited

U.S. PATENT DOCUMENTS

| | | | |
|---|---|---|---|
| 4,783,804 | 11/1988 | Juang et al. | 381/43 |
| 4,852,180 | 7/1989 | Levinson | 381/43 |
| 4,980,918 | 12/1990 | Bahl et al. | 381/43 |
| 5,033,087 | 7/1991 | Bahl et al. | 381/43 |
| 5,268,990 | 12/1993 | Cohen et al. | 395/2 |
| 5,390,278 | 2/1995 | Gupta et al. | 395/2.52 |
| 5,502,790 | 3/1996 | Yi | 395/2.65 |

FOREIGN PATENT DOCUMENTS

| | | | |
|---|---|---|---|
| 0 481 107 A1 | 10/1990 | European Pat. Off. | G10L 5/04 |
| 0 515 709 A1 | 5/1991 | European Pat. Off. | G10L 5/04 |
| 0 481 107 A1 | 4/1992 | European Pat. Off. . | |
| 0 515 709 A1 | 12/1992 | European Pat. Off. . | |
| 0 588 646 A2 | 9/1993 | European Pat. Off. | H04M 3/42 |
| 0 588 646 A2 | 3/1994 | European Pat. Off. . | |

OTHER PUBLICATIONS

European Search Report dated Oct. 9, 1995.

Fundamentals of Speech Recognition, Rabiner and Juang, Prentice Hall, 1993, p. 349.

*Primary Examiner*—Allen R. MacDonald
*Assistant Examiner*—Michael Opsasnick
*Attorney, Agent, or Firm*—Whitham, Curtis, Whitham & McGinn; Robert P. Tassinari, Jr.

[57] ABSTRACT

A speech synthesis unit comprises a text processor which breaks down text into phonemes, a prosodic processor which assigns properties such as length and pitch to the phonemes based on context, and a synthesis unit which outputs an audio signal representing the sequence of phonemes according to the specified properties. The prosodic processor includes a Hidden Markov Model (HMM) to predict the durations of the phonemes. Each state of the HMM represents a duration, and the outputs are phonemes. The HMM is trained on a set of data consisting of phonemes of known identity and duration, to allow the state transition and output distributions to be calculated. The HMM can then be used for any given input sequence of phonemes to predict a most likely sequence of corresponding durations.

10 Claims, 6 Drawing Sheets

SPEECH SYNTHESIS SYSTEM

FIELD OF THE INVENTION

The present invention relates to a speech synthesis or Text-To-Speech system, and in particular to the estimation of the duration of speech units in such a system.

BACKGROUND OF THE INVENTION

Text-To-Speech (TTS) systems (also called speech synthesis systems), permitting automatic synthesis of speech from a text are well known in the art; a TTS receives an input of generic text (e.g. from a memory or typed in at a keyboard), composed of words and other symbols such as digits and abbreviations, along with punctuation marks, and generates a speech waveform based on such text. A fundamental component of a TTS system, essential to natural-sounding intonation, is the module specifying prosodic information related to the speech synthesis, such as intensity, duration and fundamental frequency or pitch (i.e. the acoustic aspects of intonation).

A conventional TTS system can be broken down into two main units; a linguistic processor and a synthesis unit. The linguistic processor takes the input text and derives from it a sequence of segments, based generally on dictionary entries for the words. The synthesis unit then converts the sequence of segments into acoustic parameters, and eventually audio output, again on the basis of stored information. Information about many aspects of TTS systems can be found in "Talking Machines: Theories, Models and Designs", ed G. Bailly and C. Benoit, North Holland (Elsevier), 1992.

Often the speech segment used is a phoneme, which is the base unit of the spoken language (although sometimes other units such as syllables or diphones are used). The phoneme is the smallest segment of sound such that if one phoneme in a word is substituted with a different phoneme, the meaning may be changed (e.g., "c" and "t" in "coffee" and "toffee"). In ordinary spelling, some letters can represents different phonemes (e.g. "c" in "cat" and "cease") and conversely some phonemes are represented in a number of different ways (e.g. the sound "f" in "fat" and "photo") or by combinations of letters (e.g. "sh" in "dish").

It is very difficult to synthesize natural sounding speech because the pronunciation of any given phoneme varies according to e.g., speaker, adjacent phonemes, grammatical context and so on. One particular problem in a TTS system is that of estimating the duration of speech units or segments, in particular phonemes, in unseen continuous text. The prediction of the duration of phonemes in a string of phonemes representing the sound of the phrase or sentence is a fundamental component of the TTS system. The problem is difficult because the duration of each phoneme varies in a highly complex way as a function of many linguistic factors; particularly, each phoneme varies according to its neighbors (local context) and according to its placement in the sentence and paragraph (long distance effects). In addition, the many factors of known importance interact with each other.

Different methods and systems for duration prediction in a Text-To-Speech system are known in the art. The conventional approach to calculating the duration of phonemes in its required sentential context, within a TTS system, involves the construction of rules which can be used to modify standard duration values, as described in J.Allen, M. S. Hunnicutt and D. Klatt, "The prosodic component", Chapter 9 of "From Text to Speech: The MITALK system", Cambridge University Press, 1987. Such rules attempt to define typical behavior governing the behavior of phonemes in certain contexts, such as lengthening vowels in sentence final positions; the development of these rules has been carried out typically by experts (linguists and phoneticians). Although such systems have achieved useful results, their creation is a tedious process and the rule-set is difficult to modify in the light of errors. Different rule sets have been proposed, some based on higher level speech units (i.e. the syllable), as set forth in W. Campbell, "A search for higher-level duration rules in a real speech corpus" Eurospeech 1989. There has been progress to using more detailed information extracted from databases, in a variety of languages, using the same basic approach. These methods attempt to learn the rules from data by collecting many examples and picking typical values which can be used, as described in "Talking machines" Ed Bailly, Benoit, North Holland 1992 (Section III Prosody). The computation of duration by decision trees has been proposed, as described in J. Hirschberg, "Pitch accent in context: predicting intonational prominence from text", Artificial Intelligence, vol.63, pp.305–340, Elsevier, 1993. Decision tree methods tend to require rather large amounts of training data, due to their method of node splitting, unless particular techniques are adopted to avoid this; furthermore, even when successful, it can be difficult to combine the static classifier with other dynamic prior information.

Alternatively, approaches using neural nets can be used, as set forth in W. N. Campbell, "Syllable-based segmental duration", pp.211–224 of "Talking machines" Ed Bailly, Benoit, North Holland, 1992; however, this model has so far not proved entirely satisfactory, and the generally higher computational cost of training such systems may cause problems.

Thus the prior art does not provide a satisfactory method of predicting phoneme duration which can be used to predict perceptually plausible durations for phonemes in any practically occurring context. The rules of the known methods are generally neither precise enough nor extensive enough to cover all contexts; known procedures may also require excessive computational time, or excessive amounts of data to correctly initialize.

SUMMARY OF THE INVENTION

Accordingly, the present invention provides a method for generating synthesized speech from input text, the method comprising the steps of:

- decomposing the input text into a sequence of speech units;
- estimating a duration value for each speech unit in the sequence of speech units;
- synthesizing speech based on said sequence of speech units and duration values;
- characterized in that said estimating step utilizes a Hidden Markov Model (HMM) to determine the most likely sequence of duration values given said sequence of speech units, wherein each state of the HMM represents a duration value and each output from the HMM is a speech unit.

The use of an HMM to predict duration values has been found to produce very satisfactory (i.e., natural-sounding) results. The HMM determines a globally optimal or most likely set of durations values to match the sequence of speech values, rather than simply picking the most likely duration for each individual speech unit. The model may incorporate as much context and prosodic information as the available computing power permits, and may be steadily improved by for example increasing the number of HMM states (and therefore decreasing the quantization interval of phoneme durations). Note that other parameters such as pitch must also be calculated for speech synthesis; these are determined in accordance with known prior art techniques.

In a preferred embodiment, the state transition probability distribution of the HMM is dependent on one or more of the immediately preceding states, in particular, on the identity of the two immediately preceding states, and the output probability distribution of the HMM is dependent on the current state of the HMM. These dependencies are a compromise between accuracy of prediction, and the limited availability of computing power and training data. In the future it is hoped to be able to include additional grammatical context, such as location in a phrase, to further enhance the accuracy of the predicted durations.

In order to set up the HMM it is necessary to determine the initial values of the state transition and output distribution probabilities. Whilst in theory these might be specified by hand originally, and then improved by training on sentences of known total duration, the preferred method is to obtain a set of speech data which has been decomposed into a sequence of speech units, each of which has been assigned a duration value; and to estimate the state transition probability distribution and the output probability distribution of the HMM from said set of speech data. Note that since the HMM probabilities are taken from naturally occurring data, if the input data has been spoken by a single speaker, then the HMM will be modelled on that single speaker. Thus this approach allows for the provision of speaker-dependent speech synthesis.

The simplest way to derive the state transition and output probability distributions from the aligned data is to count the frequency with which the given outputs or transitions occur in the data, and normalize appropriately. However, since the amount of training data is necessarily limited, preferably the step of estimating the state transition and output probability distributions of the HMM includes the step of smoothing the set of speech data to reduce any statistical fluctuations therein. The smoothing is based on the fact that the state transition probability distribution and distribution of durations for any given phoneme are expected to be reasonably smooth, and has been found to improve the quality of the predicted durations. There are many well-known smoothing techniques available for use.

Although the data to train the HMM could in principle be obtained manually by a trained linguist, this would be very time-consuming. Preferably, the set of speech data is obtained by means of a speech recognition system, which can be configured to automatically align large quantities of data, thereby providing much greater accuracy.

It should be appreciated that there is no unique method of specifying the optimum or most likely state sequence for an HMM. The most commonly adopted approach, which is used for the present invention, is to maximize the probability for the overall path through the HMM states. This allows the most likely sequence of duration values to be calculated using the Viterbi algorithm, which provides a highly efficient computational technique for determining the maximum likelihood state sequence.

Preferably each of said speech units is a phoneme, although the invention might also be implemented using other speech units, such as syllables, fenemes, or diphones. An advantage of using phonemes is that there is a relatively limited number of them, so that demands on computing power and memory are not too great, and moreover the quality of the synthesized speech is good.

The invention also provides a speech synthesis system for generating synthesized speech from input text comprising:

- a text processor for decomposing the input text into a sequence of speech units;
- a prosodic processor for estimating a duration value for each speech unit in the sequence of speech units;
- a synthesis unit for synthesizing speech based on said sequence of speech units and duration values;
- and characterized in that said prosodic processor utilizes a Hidden Markov Model (HMM) to determine the most likely sequence of duration values given said sequence of speech units, wherein each state of the HMM represents a duration value and each output from the HMM is a speech unit.

FIGURES

An embodiment of the invention will now be described in detail by way of example, with reference to the accompanying figures, where:

DETAILED DESCRIPTION

Figure 1:
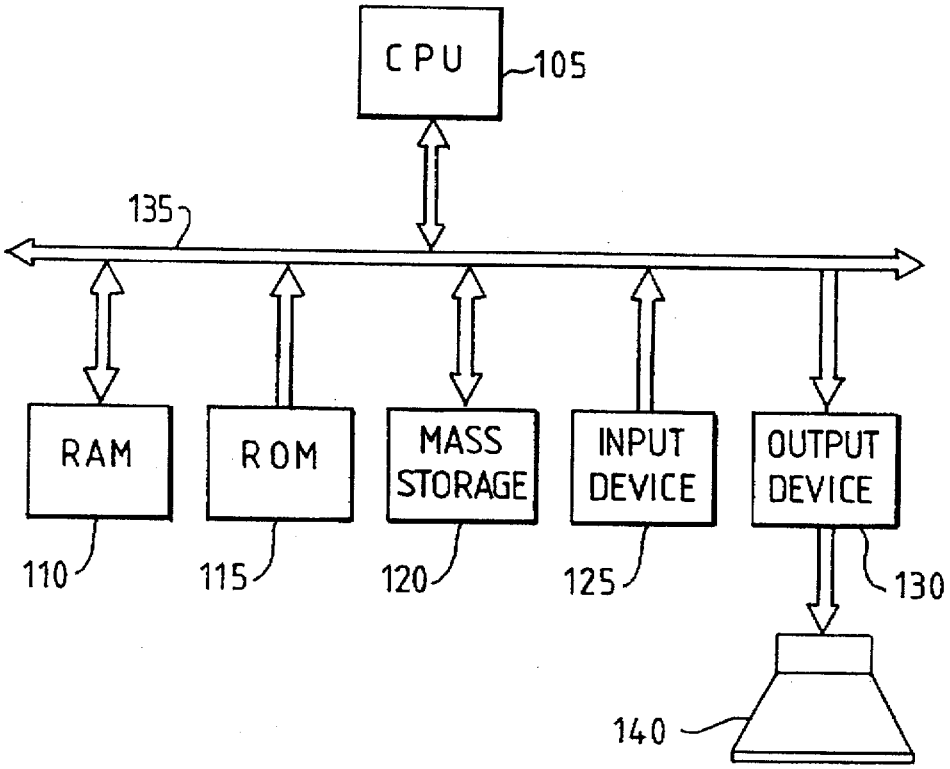
FIG. 1 is a view of a data processing system which may be utilized to implement the method and system of the present invention.

With reference now to the Figures and in particular with reference to FIG. 1, there is depicted a data processing system which may be utilized to implement the present invention, including a central processing unit (CPU) 105, a random access memory (RAM) 110, a read only memory (ROM) 115, a mass storage device 120 such as a hard disk, an input device 125 and an output device 130, all interconnected by a bus architecture 135. The text to be synthesized is input by the mass storage device or by the input device, typically a keyboard, and turned into audio output at the output device, typically a loud speaker 140 (note that the data processing system will typically include other parts such as a mouse and display system, not shown in FIG. 1, which are not relevant to the present invention). An example of a data processing system which may be utilized to implement the present invention is a RISC System/6000 equipped with a Multimedia Audio Capture and Playback adapter card, both available from International Business Machines Corporation, although many other hardware systems would also be suitable.

Figure 2:
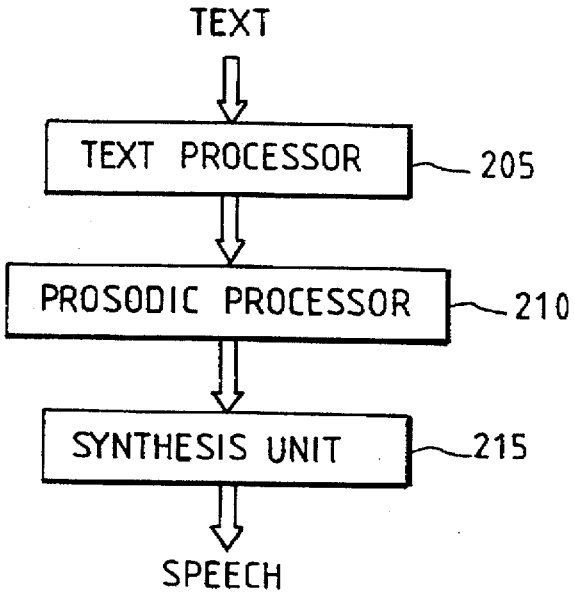
FIG. 2 is a schematic block diagram of a Text-To-Speech system.

With reference now to FIG. 2, a schematic block diagram of a Text-To-Speech system is shown. The input text is transferred to the text processor 205, that converts the input text into a phonetic representation. The prosodic processor 210 determines the prosodic information related to the speech utterance, such as intensity, duration and pitch. Then a synthesis unit 215, using such information as filter coefficients, synthesizes the speech waveform to be generated. It should be appreciated at the level illustrated in FIGS. 1 and 2 the TTS system is still completely conventional, and could be easily implemented by the person skilled in the art.

The advance of the present invention relates essentially to the prosodic processor, as described in more detail below.

Figure 3:
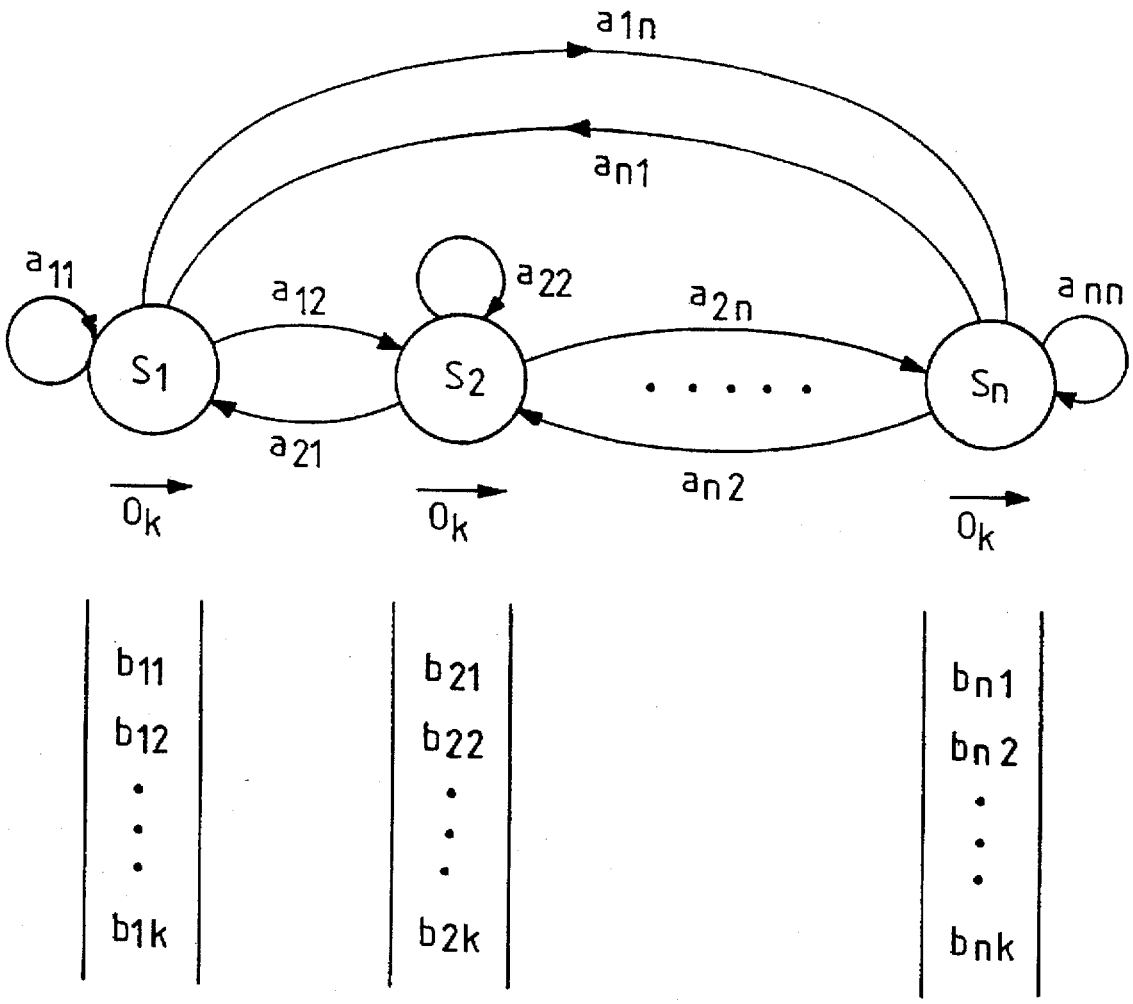
FIG. 3 illustrates an example of a Hidden Markov Model.

The present invention utilizes a Hidden Markov Model (HMM) to estimate phoneme durations. FIG. 3 illustrates an example of an HMM, which is a finite state machine having two different stochastic functions: a state transition probability function and an output probability function. At discrete instants of time, the process is assumed to be in some state and an observation is generated by the output probability function corresponding to the current state. The underlying HMM then changes state according to its transition probability function. The outputs can be observed but the states themselves cannot be directly observed; hence the term "hidden" models. HMMs are described in L. R. Rabiner, "A tutorial on Hidden Markov Models and selected applications in speech recognition", p257–286 in Proceedings IEEE, Vol 77, No 2, Feb 1989, and "An Introduction to the Application of the Theory of Probabilistic Functions of a Markov Process to Automatic Speech Recognition" by Levinson, Rabiner and Sondhi, p1035–1074, in Bell System Technical Journal, Vol 62 No 4, April 1983.

With reference now to the example set forth in FIG. 3, the depicted HMM has N states ($S_1$, $S_2$, . . . $S_n$). The state transition function is represented by a stochastic matrix $A=[a_{ij}]$, with i, j=1. . . N; $a_{ij}$ is the probability of the transition from $S_i$ to $S_j$, where $S_i$ is the current state, so that $\Sigma_j a_{ij}=1$. If $O_k$, with k=1. . . M, represents the set of possible output values, the output probability function is collectively represented by another stochastic matrix $B=[b_{ik}]$, with i=1. . . N and k=1. . . M; $b_{ik}$ is the probability of observing the output $O_k$ given the current state $S_i$. The model shown in FIG. 3, where from each state it is possible to reach every other state of the model, is referred to as an Ergodic Hidden Markov Model.

Hidden Markov Models have been widely used in the field of speech recognition. Recently this methodology has been applied to problems in Speech Synthesis, as described for-example in P. Pierucci, A. Falaschi, "Ergodic Hidden Markov Models for speech synthesis", pp.1147–1150 in "Signal Processing V: Theories and Applications", ed L. Torres, E. Masgrau and M. A. Lagunas, Elsevier, 1990 and in particular to problems in TTS, as described in S. Parfitt and R. A. Sharman, "A Bidirectional Model of English Pronunciation", Eurospeech, Geneva, 1991.

However, HMMs have never been deemed suitable for application to model segment duration from prior information in a TTS. As explained in more detail later, a direct approach is used to the calculate duration using an HMM specially designed to model the typical variations of phoneme duration observed in continuous speech.

In order to create a duration HMM which can estimate the duration of each phonetic segment in continuous speech output, let $F=f_1, f_2, \ldots, f_n$, be a sequence of phonemes; in a TTS system, this is produced by the letter-to-sound transcription from the input text performed by the text processor. Let $D=d_1,d_2,\ldots,d_n$, be a sequence of duration values, where $d_i$ (with i=1. . . n) is the duration of the phoneme $f_i$. We require a TTS which will observe the phoneme F and produce the duration D; consequently, we require to be able to compute the conditional probability P(D|F) for any possible sequence of duration values. Using Bayes Theorem, this can be expanded as:

$$P(D|F)=\left[\frac{P(F|D)\cdot P(D)}{P(F)}\right]$$

Since we are interested in only the best sequence of durations it is therefore natural to seek the maximum likelihood value of the conditional probability, or $$\max_D [P(D|F)],$$

where the maximization is taken over all possible D. Applying this to the right hand side of the above equation, and eliminating terms which are not relevant to the maximization, yields the requirement to find the $$\max_D [P(F|D)\cdot P(D)].$$

In this expression the P(F|D) relates to the distribution of phonemes for any given duration; additionally the term P(D) which is the a priori likelihood of any phoneme duration sequence, can be understood as a model of the metrical phonology of the language.

This approach therefore requires a duration HMM in which the states are durations, and the output are phonemes; any state can output some phoneme, and then transfer to some other state, so that the class of models proposed is ergodic HMM's. The two independent stochastic distributions which characterize the duration HMM are the output distribution P(F|D) and the state transition distribution P(D).

The use of a continuous variable, duration in milliseconds for example, as a state variable, would normally pose severe computational difficulties. However, typical durations are small, say 20 to 280 ms, and can readily be quantized, say to 10 ms intervals, giving a small finite state set which is easily manageable. Finer resolution can of course be obtained directly by increasing the number of states.

The state transition distribution, P(D), is most readily calculated as a bi-gram distribution by making the approximation:

$$P(D)=\Pi P(d_i|d_{i-1})$$

based on the (incomplete) hypothesis that only the preceding phoneme duration affects the duration of the current phoneme. If the durations are quantized into say 50 possible durations, this leads to a state transition matrix of 2500 elements, again easily computable. More context can readily be incorporated using higher order models to take much larger contexts into account. In fact, the current implementation permits 20 different durations from 10 milliseconds (ms) up to 200 ms at 10 ms intervals, and uses a tri-gram model in which the probability of any given duration is dependent on the previous two durations $$(\text{i.e., } P(D)=P(D)=\prod_I P(d_i|d_{i-1}\,d_{i-2}).$$

The use of the tri-gram model is a compromise between overall accuracy (which generally improves with higher order models) and the limitations on the amount of computing resources and training data. In other circumstances, bi-grams, 4-grams and so on may be more appropriate.

Analogously, the output distribution, P(F|D), is most readily calculated by making the approximation:

$$P(F|D)=\Pi P(f_i|d_i)$$

Thus effectively this probability simply reflects the likelihood of a phoneme given a particular duration, which in turn depends on (a) the overall frequency of phonemes, and (b) the distribution of durations for phonemes.

Note that neither the state transition distribution nor the output distribution have any dependency on the phoneme output by the previous stage. Whilst this might be regarded as artificial, the independence of the state transition distribution from the output distribution is important in order to provide a tractable model, as is the simplicity of the output distribution.

Figure 4:
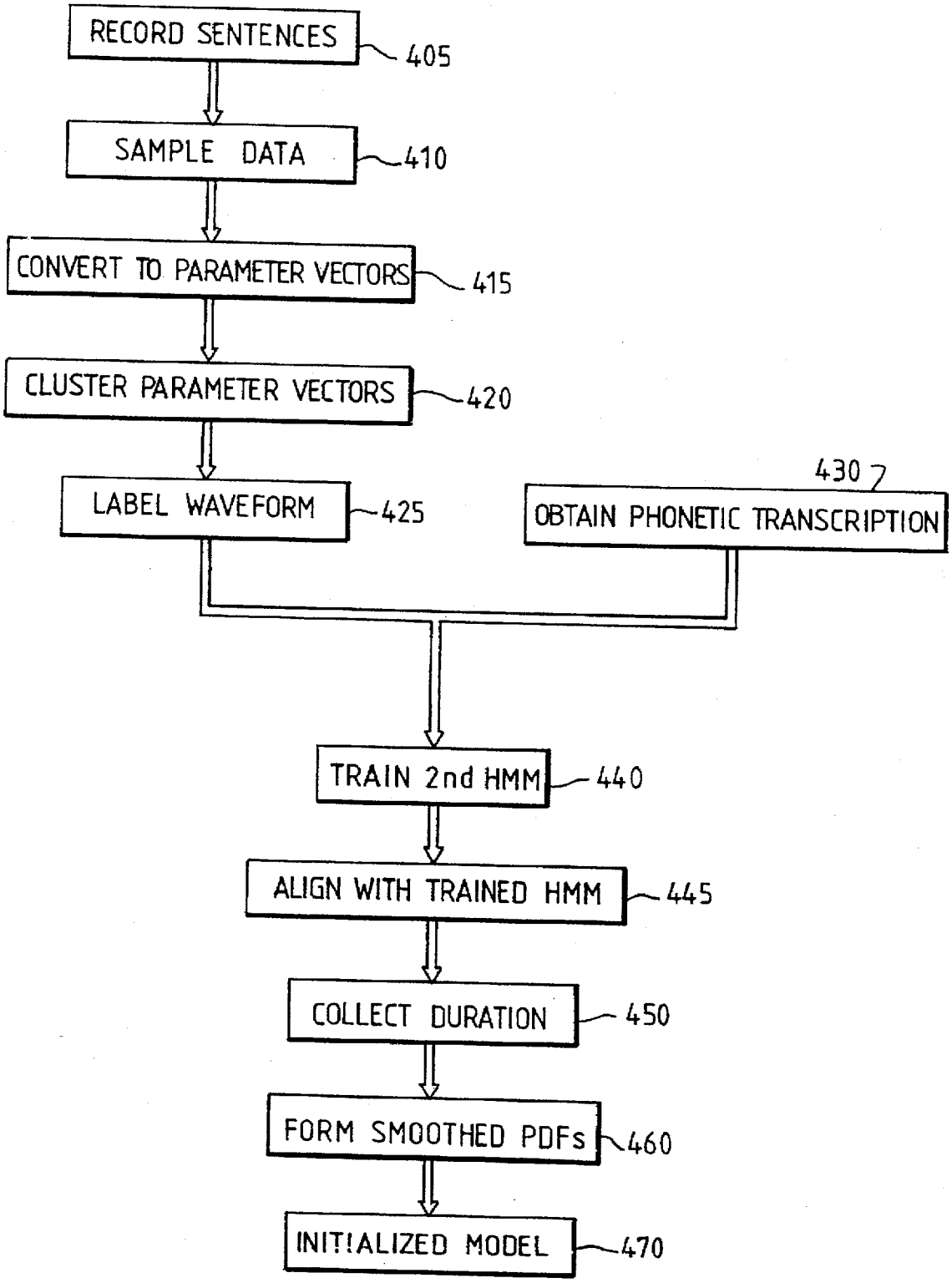
FIG. 4 is a schematic flickered showing the construction of the Hidden Markov Model.

In order to create the duration HMM, it is necessary to determine the parameters of the model, in this case the state transition distribution and the output distribution. This requires the use of a large amount of consistent and coherent speech, at least some of which has been phonetically aligned. This can in fact be obtained using the front end of a automatic speech recognition system. With reference now to FIG. 4, a schematic flickered showing the training and definition of the duration model is depicted. The process starts at block 405 where, in order to collect data, sentences uttered by a speaker are recorded; a large number of sentences is used, e.g. a set of 150 sentences of about 12 words each by a single speaker dictating in a continuous, fluent style, constituting about 30 minutes of speech, including pauses. Continuous (and not discrete) speech data is required.

Referring now to block 410, the data collected is sampled at finite intervals of time at a standard rate (e.g. 11 KHz) to convert it to a discrete sequence of analog samples, filtered and pre-emphasized; then the samples are converted to a digital form, to create a digital waveform from the analog signal recorded.

At block 415 these sequences of samples are converted to a set of parameter vectors corresponding to standard time slices (e.g. 10 ms) termed fenemes (or alternatively fenones), using the first stage of a speaker-dependent large vocabulary speech recognition system. A speech recognition process is now performed on these data, starting at block 420, where the parameter vectors are clustered for the speaker, and replaced by vector quantized (VQ) parameters from a codebook—i.e., the codebook contains a standard set of fenemes, and each original feneme is replaced by the one in the codebook to which it is closest. Note that because it is desired to obtain a precise alignment of fenemes with phonemes, rather than simply determine which sequence of phonemes occurred, the size of the codebook used may be rather larger than that typically used for speech recognition (eg 320 fenemes). This processing of a speech waveform into a series of fenemes taken from a codebook is well-known in the art (see e.g. "Vector Quantization in speech coding" by Makhoul, Roucos, and Gish, Proceedings of the IEEE, v73, n11, p1551–1588, November 1985).

Referring now to block 425, each waveform is labelled with the corresponding feneme name from the codebook. The fenemes are given names indicative of their correlation with the onset, steady state and termination of the phoneme to which they belong. For example, the sequence . . . B2,B2,B3,B3,AE1,AE1,AE2,AE2, . . . might represent 80 ms of transition from a plosive consonant to a stressed vowel. Normally however, the labelling is not precise enough to determine a literal mapping to phonemes since noise, coarticulation, and speaker variability lead to errors being made; instead a second HMM is trained to correlate a state sequence of phonemes to an observation vector of fenemes. This second HMM has phonemes as its states and fenemes as its outputs.

Referring now to block 430, the phonetic transcription of each sentence is obtained; it can be noted that the first phase of the TTS system can be used to obtain the phonetic transcription of each orthographic sentence (the present implementation is based on an alphabet of 66 phonemes derived from the International Phonetic alphabet). The second HMM is then trained at block 440 using the Forward-backward algorithm to obtain maximum likelihood optimum parameter values.

Once the second HMM has been correctly trained, it is then possible to use this HMM to align the sample phonetic-fenemic data (step 445). Obviously, it is only necessary to train the second HMM once; subsequent data sets can be aligned using the already trained HMM. After the alignment has been performed, it is then trivial to assign each phoneme a duration based on the number of fenemes aligned with it (step 450). Note that the purpose of the steps so far has simply been to derive a large set of training data comprising text broken down into phonemes, each having a known duration. Such data sets are already available to the skilled person, e.g. see Hauptmann, "SPEAKEZ: A First Experiment In Concatentation Synthesis from a Large Corpus", p1701–1704 in Eurospeech 93, who also uses a speech recognition system to automatically obtain such a data set. In theory the data could also be obtained manually by a trained linguist, although it would be extremely time-consuming to collect a sufficient quantity of data in this way.

In order to build a duration model, the duration and transition probability functions can be obtained by analysis of the aligned corpus. The simplest way to derive the probability functions is by counting the frequency with which the given outputs or transitions occur in the data, and normalizing appropriately; e.g. for the output distribution function, for any given output duration ($d_i$, say) the probability of a given phoneme ($f_k$, say) can be estimated as the number of times that phoneme $f_k$ occurs with duration $d_i$ in the training data, divided by the total number of times that duration $d_i$ occurs in the training data.

$$ie\ b_{ik}=N(f_k|d_i)/Nd_i$$

where N is used to denote the number of times its argument occurs in the training data. Exactly the same procedure can be used with the state transition diagram, i.e., counting the number of times each duration or state is preceded by any other given state (or pair of states for a tri-gram model). A probability density function (pdf) of each distribution is then formed.

In the tri-gram model currently employed for the state transition distribution, there are 20 durations, leading to $20^3$ contexts (=8000). However, many of the contexts cannot occur in practical speech, so that the number of contexts actually stored is rather less than the maximum.

In practice it is found that the number of occurrences within any given set of training data is susceptible to statistical fluctuations, so that some form of smoothing is desirable. Many different smoothing techniques are available; the one adopted here is to replace each duration in the sequence of durations with a family of weighted durations. The original duration is retained with a weight of 50%, and extra durations 10 ms above and below it are formed, each having a weight of 25%. This mimics a Gaussian of fixed dispersion centered on the original duration. The values of $b_{ik}$ can then be calculated according to the above formula, but using the weighted families of durations to calculate $N(f_k|d_i)$ and $N(d_i)$, as opposed to the single original duration values. Likewise, the state transition distribution matrix is calculated by counting each possible path from a first family to a second family to a third family (for tri-gram probabilities). At present there is no weighting of the different paths, although this might be desirable so that a path through an actually observed duration carries greater weight than a path through the other durations in the family.

The above smoothing technique is very satisfactory, in that it is computationally straightforward, avoids possible problems such as negative probabilities, and has been found to provide noticeably better performance than a non-smoothed model. Some fine tuning of the model is possible (eg to determine the best value of the Gaussian dispersion). Alternatively, the skilled person will be aware of a variety of other smoothing techniques that might be employed; for example, one could parameterize the duration distribution for any given phoneme, and then use the training data to estimate the relevant parameters. The effectiveness of such other smoothing techniques has not been investigated.

Thus returning to FIG. 4, in step 460 the smoothed output and state transition probability distribution functions are calculated based on the collected distributions. These are then used to form the initialized HMM in step 470. Note that there is no need to further train or update the HMM during actual speech synthesis.

Figure 5:
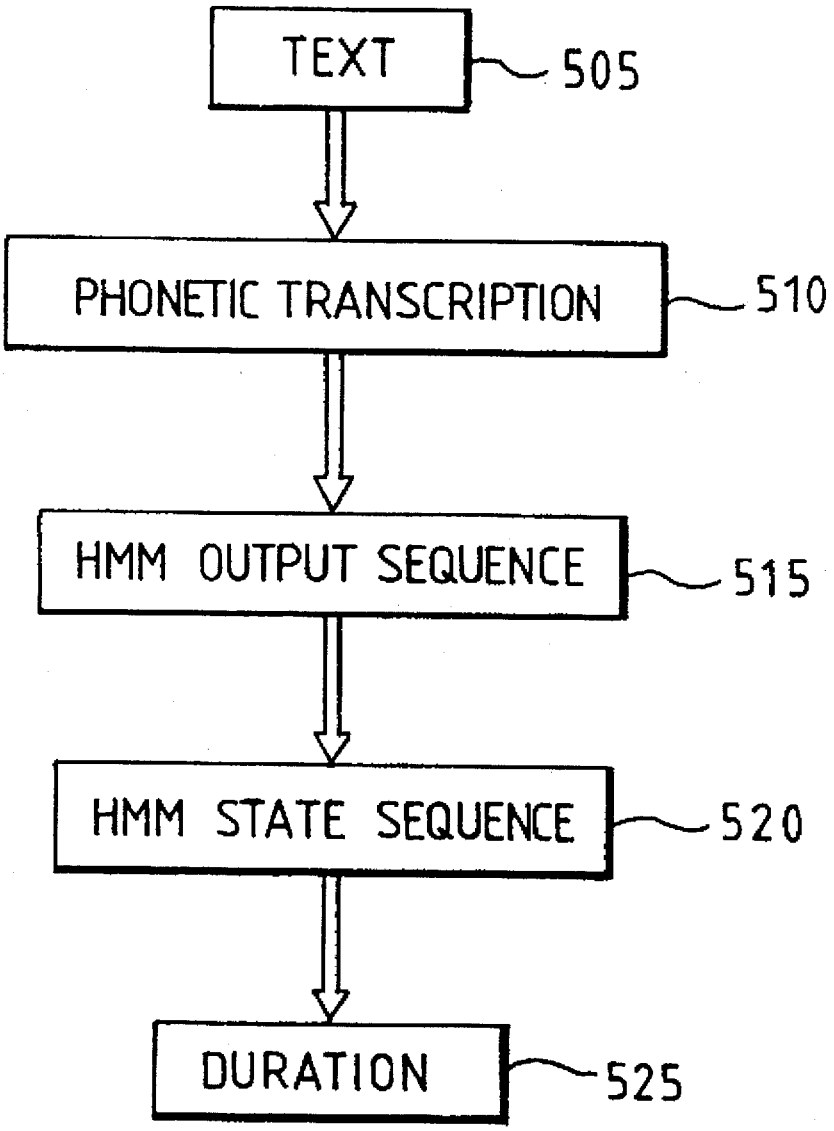
FIG. 5 is a schematic flickered showing the use of the model for duration estimation.

The duration HMM can now be used in a simple generative sense, estimating the maximum likelihood value of each phoneme duration, given the current phoneme context. Referring now to FIG. 5, at block 505 a generic text is read by an input device, such as a keyboard. The input text is converted at block 510 into a phonetic transcription by a text processor, producing a phoneme sequence. Referring now to block 515, the phoneme sequence of the input text is used as the output observation sequence for the duration HMM. At block 520, the state sequence of the duration HMM is computed using an optimal decoding technique, such as the Viterbi algorithm. In other words, for the given F, a path through the state sequence (equivalent to D) is determined which maximizes P(D|F) according to the specified criteria. Note that such a calculation represents a standard application of an HMM and is very well-known to the skilled person (see e.g. "Problem 2" in the above-mentioned Rabiner reference). The state sequence is then used at block 525 to provide the estimated phoneme durations related to the input text. Note that each sequence of phonemes is conditioned to begin and terminate with a particular phoneme of fixed duration (which is why there is no need to calculate the initial starting distribution across the different states).

This model computes the maximum likelihood value of each phoneme duration, given the current phoneme context. It is worth noting that the duration HMM does not simply pick the most likely (typical) duration of each phoneme, rather, it computes the globally most likely sequence of durations which match the given phonemes, taking into account both the general model of phoneme durations, and the general model of metrical phonology, as captured by the probability distributions specified. The solution is thus "globally optimal", subject to approximating constraints.

Figure 6:
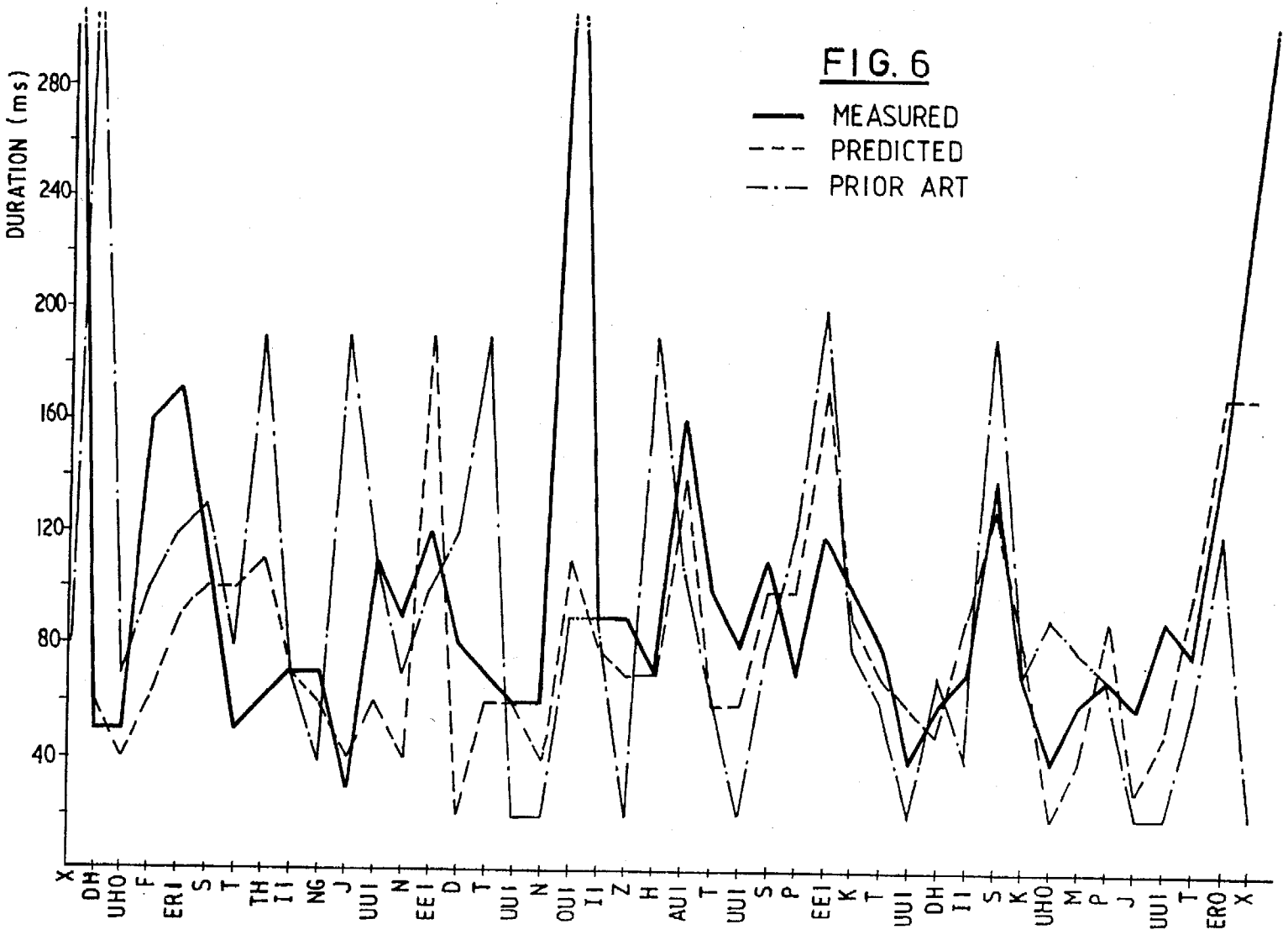
FIGS. 6 and 7 are graphs illustrating the performance of the Hidden Markov Model.
Figure 7:
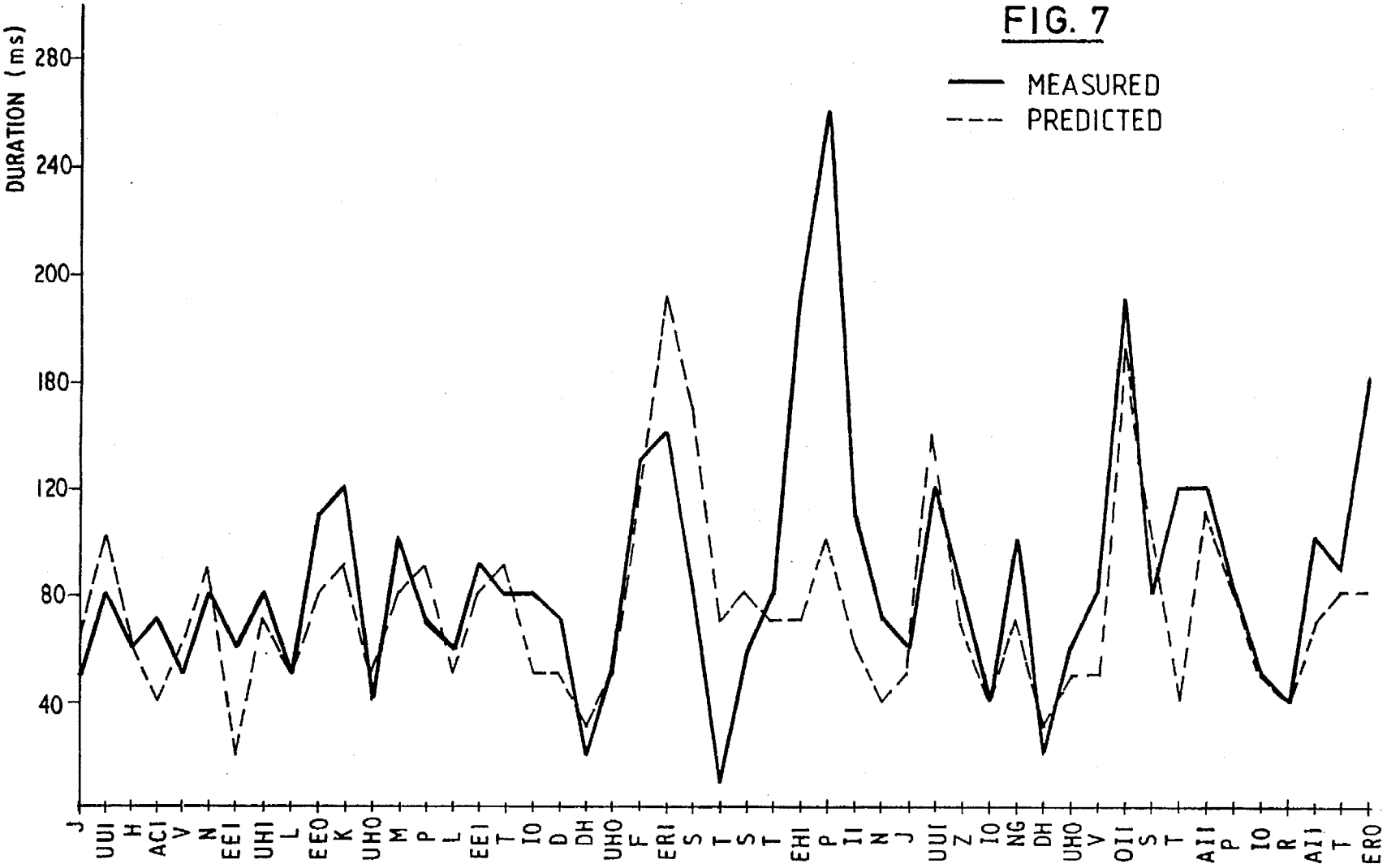

Examples of the use of the HMM to predict phoneme durations are shown in FIGS. 6 and 7 for the sentences "The first thing you need to know is how to speak to this computer", and "You have nearly completed the first step in using the voice typewriter" respectively. The raw data for these graphs is presented in Tables 1 and 2. All durations are given in milliseconds and are quantized in units of 10 ms (the duration of a single phoneme). The phonemes labelled using conventional nomeclature; "X" represents silence, so the extremities of the graphs should be disregarded. The data in FIG. 6 was actually included in the training data used to derive the original state transition and output probability distributions, whilst the data in FIG. 7 was not. This data demonstrates the utility of the method in predicting unknown values for new sentences.

The graphs show measured durations as spoken by a natural speaker in the full line. The measured durations for FIG. 6 were obtained automatically as described above using the front end of a speech recognition system, those for FIG. 7 by manual investigation of the speech wave pattern. The durations predicted by the HMM are shown in the dashed line. FIG. 6 also includes "prior art" predicted values (shown by the dot-dashed line), where a default value is used for each phoneme in a given context. Whilst more sophisticated systems are known, the use of the HMM is clearly a significant advance over this prior art method at least.

The performance of the HMM text to speech system provides a very effective way of estimating phoneme durations. The largest errors generally represent effects not yet incorporated into the HMM. For example, in FIG. 6 (Table 1), the predicted duration of the "OU1" phoneme in "know" is noticeably too short; this is because in natural speech phrase-final lengthening extends the duration of this phoneme. In FIG. 7 it can be seen that the natural speaker slurred together the words "first" and "step", resulting in the very short measured duration for the final "T" of "first". Such higher-level effects can be incorporated into the model as it is further refined in the future.

It may be appreciated that the duration model may be steadily improved by increasing the amount of training data or changing different parameters in the Hidden Markov Models. It may also be readily improved by increasing the amount of phonetic context modelled. The quantization of the phoneme durations being modelled may be reduced to improve accuracy; the fenemes can be modelled directly, or alternatively longer speech units such as syllables or diphones used. In all these cases there is a direct trade-off between computing power and memory constraints, and accuracy of prediction. Furthermore, the model can be made arbitrarily complex, subject to computation limits, in order to use a variety of prior information, such as phonetic and grammatical structure, part-of-speech tags, intention markers, and so on; in such case the probability P(D|F) is extended to P(D|F,G), where the conditioning is based on the other prior information such as the results of a grammatical analysis. One example of this would be where G represents the distance of the phoneme from a phrase boundary.

As can be appreciated, the duration model has been trained on naturally occurring data, taking the advantage of learning directly from naturally occurring data; the duration model obtained can then be used in any practically occurring context. In addition, since the system is trained on a real speaker, it will react like that specific speaker, producing a speaker-dependent synthesis. Thus the technique described herein allows for the production of customized speech output; providing the ability to create speaker-dependent synthesis, in order to have a system that reacts like a specific speaker. It is worth noting that a future aim of producing totally speaker-dependent speech synthesis can be possible if all the stages of linguistic processing, prosody and audio synthesis can be subjected to a similar methodology. In that case the tasks of producing a new voice quality for a TTS system will be largely based on the enrolment data spoken by a human subject, similar to the method of speaker enrolment for a speech recognition system.

Furthermore, the data collection problem may be largely automated by extracting training data from a speaker-dependent continuous speech recognition system, using the speech recognition system to do automatic alignment of naturally occurring continuous speech. The possibility of obtaining a relatively large speaker-specific corpus of data, from a speaker-dependent speech recognition system, is a step towards the aim of producing natural sounding synthetic speech with selected speaker characteristics.

TABLE 1

Comparison of measured, predicted, and prior art (predicted) phoneme durations (all in milliseconds) for the sentence "The first thing you need to know is how to speak to this computer".

| PHONEME | MEASURED DURATION | PREDICTED DURATION | PRIOR ART DURATION |
|---|---|---|---|
| DH | 5 | 6 | 33 |
| UHO | 5 | 4 | 7 |
| F | 16 | 6 | 10 |
| ER1 | 17 | 9 | 12 |
| S | 11 | 10 | 13 |
| T | 5 | 10 | 8 |
| TH | 6 | 11 | 19 |
| I1 | 7 | 7 | 7 |
| NG | 7 | 6 | 4 |
| J | 3 | 4 | 20 |
| UU1 | 11 | 6 | 11 |
| N | 9 | 4 | 7 |
| EE1 | 12 | 19 | 10 |
| D | 8 | 2 | 12 |
| T | 7 | 6 | 19 |
| UU1 | 6 | 6 | 2 |
| N | 6 | 4 | 2 |
| OU1 | 43 | 11 | 9 |
| I1 | 9 | 8 | 9 |
| Z | 9 | 7 | 2 |
| H | 7 | 7 | 19 |
| AU1 | 16 | 14 | 11 |
| T | 10 | 6 | 6 |
| UU1 | 8 | 6 | 2 |
| S | 11 | 10 | 8 |
| P | 7 | 10 | 12 |
| EE1 | 12 | 17 | 20 |
| K | 10 | 9 | 8 |
| T | 8 | 7 | 6 |
| UU1 | 4 | 6 | 2 |
| DH | 6 | 5 | 7 |
| I1 | 7 | 9 | 4 |
| S | 14 | 13 | 19 |
| K | 7 | 8 | 7 |
| UHO | 4 | 2 | 9 |
| M | 6 | 4 | 8 |
| P | 7 | 9 | 7 |
| J | 6 | 3 | 2 |
| UU1 | 9 | 5 | 2 |
| T | 8 | 10 | 6 |
| ERO | 15 | 17 | 12 |

TABLE 2

Comparison of measured and predicted phoneme durations (all in milliseconds) for the sentence "You have nearly completed the first step in using the voice typewriter".

| PHONEME | MEASURED DURATION | PREDICTED DURATION |
|---|---|---|
| J | 5 | 6 |
| UU1 | 8 | 10 |
| H | 6 | 6 |
| AE1 | 7 | 4 |
| V | 5 | 6 |
| N | 8 | 9 |
| EE1 | 6 | 2 |
| UH1 | 8 | 7 |

TABLE 2-continued

Comparison of measured and predicted phoneme durations (all in milliseconds) for the sentence "You have nearly completed the first step in using the voice typewriter".

| PHONEME | MEASURED DURATION | PREDICTED DURATION |
|---|---|---|
| L | 5 | 5 |
| EEO | 11 | 8 |
| K | 12 | 9 |
| UHO | 4 | 5 |
| M | 10 | 8 |
| P | 7 | 9 |
| L | 6 | 5 |
| EE1 | 9 | 8 |
| T | 8 | 9 |
| IO | 8 | 5 |
| D | 7 | 5 |
| DH | 2 | 3 |
| UHO | 5 | 5 |
| F | 13 | 12 |
| ER1 | 14 | 19 |
| S | 8 | 15 |
| T | 1 | 7 |
| S | 6 | 8 |
| T | 8 | 7 |
| EH1 | 19 | 7 |
| P | 24 | 10 |
| I1 | 11 | 6 |
| N | 7 | 4 |
| J | 6 | 5 |
| UU1 | 12 | 14 |
| Z | 8 | 5 |
| IO | 4 | 4 |
| NG | 10 | 7 |
| DH | 2 | 3 |
| UHO | 6 | 5 |
| V | 8 | 5 |
| OI1 | 17 | 15 |
| S | 8 | 10 |
| T | 12 | 4 |
| AI1 | 12 | 11 |
| P | 8 | 8 |
| IO | 5 | 5 |
| R | 4 | 4 |
| AI1 | 10 | 7 |
| T | 9 | 8 |
| ERO | 16 | 8 |

We claim:

1. A method for generating synthesized speech from input text, the method comprising the steps of:

decomposing the input text into a sequence of speech units;

estimating a duration value for each speech unit in the sequence of speech units;

synthesizing speech based on said sequence of speech units and duration values;

characterized in that said estimating step utilizes a Hidden Markov Model (HMM) to determine the most likely sequence of duration values given said sequence of speech units, wherein each state of the HMM represents a duration value and each output from the HMM is a speech unit.

2. The method according to claim 1, wherein a state transition probability distribution of the HMM is dependent on one or more of the immediately preceding states.

3. The method according to claim 2, wherein the state transition probability distribution of the HMM is dependent on the identity of the two immediately preceding states.

4. The method according to claim 1, wherein an output probability distribution of the HMM is dependent on the current state of the HMM.

5. The method according to claim 1, further comprising the steps of:

obtaining a set of speech data which has been decomposed into a sequence of speech units, each of which has been assigned a duration value;

estimating a state transition probability distribution and an output probability distribution of the HMM from said set of speech data.

6. The method according to claim 5, wherein the step of estimating the state transition and output probability distributions of the HMM includes the step of smoothing the set of speech data to reduce any statistical fluctuations therein.

7. The method according to claim 6, wherein the set of speech data is obtained by means of a speech recognition system.

8. The method according to claim 7, wherein the determination of the most likely sequence of duration values is performed using the Viterbi algorithm.

9. The method according to claim 8, wherein each of said speech units is a phoneme.

10. A speech synthesis system for generating synthesized speech from input text comprising:

a text processor for decomposing the input text into a sequence of speech units;

a prosodic processor for estimating a duration value for each speech unit in the sequence of speech units;

a synthesis unit for synthesizing speech based on said sequence of speech units and duration values;

and characterized in that said prosodic processor utilizes a Hidden Markov Model (HMM) to determine the most likely sequence of duration values given said sequence of speech units, wherein each state of the HMM represents a duration value and each output from the HMM is a speech unit.

* * * * *